US008881742B2

(12) United States Patent
Zephyr et al.

(10) Patent No.: US 8,881,742 B2
(45) Date of Patent: Nov. 11, 2014

(54) HAIR AUGMENTER ATTACHMENT DEVICE INCLUDING HAIR CLIP POCKETS

(71) Applicants: Jose A. Zephyr, Washington, DC (US); Marie L. Zephyr, Washington, DC (US); Wilise Zephyr, Washington, DC (US)

(72) Inventors: Jose A. Zephyr, Washington, DC (US); Marie L. Zephyr, Washington, DC (US); Wilise Zephyr, Washington, DC (US)

( * ) Notice: Subject to any disclaimer, the term of this patent is extended or adjusted under 35 U.S.C. 154(b) by 0 days.

(21) Appl. No.: 14/112,865

(22) PCT Filed: May 15, 2013

(86) PCT No.: PCT/US2013/041203

§ 371 (c)(1),
(2), (4) Date: Oct. 18, 2013

(87) PCT Pub. No.: WO2013/173490

PCT Pub. Date: Nov. 21, 2013

(65) Prior Publication Data

US 2014/0196739 A1 Jul. 17, 2014

Related U.S. Application Data

(60) Provisional application No. 61/647,656, filed on May 16, 2012.

(51) Int. Cl.
*A41G 5/00* (2006.01)
*A41G 3/00* (2006.01)

(52) U.S. Cl.
CPC ..... *A41G 5/0073* (2013.01)
USPC ..... 132/201; 132/53

(58) Field of Classification Search
USPC ..... 132/201, 53–56, 101, 105
See application file for complete search history.

(56) References Cited

U.S. PATENT DOCUMENTS

| | | | | |
|---|---|---|---|---|
| 5,204,994 | A * | 4/1993 | Herzberg et al. | 2/171 |
| 5,813,418 | A | 9/1998 | Pillars | |
| 7,861,729 | B2 | 1/2011 | Zephyr et al. | |
| 2002/0056464 | A1 * | 5/2002 | Nakane et al. | 132/53 |
| 2003/0140934 | A1 * | 7/2003 | Sugai et al. | 132/53 |
| 2003/0154994 | A1 | 8/2003 | Ra | |
| 2011/0284397 | A1 | 11/2011 | Batres et al. | |

FOREIGN PATENT DOCUMENTS

KR 20-0240725 Y1 9/2001

OTHER PUBLICATIONS

International Search Report and Written Opinion mailed Sep. 6, 2013 as received in corresponding International Application No. PCT/US2013/041203, 9 pages.

* cited by examiner

*Primary Examiner* — Rachel Steitz
(74) *Attorney, Agent, or Firm* — Foley & Lardner LLP

(57) ABSTRACT

An apparatus comprises a hair clip pocket that includes a first hair clip pocket panel located on a first side of the hair clip pocket, a second hair clip pocket panel located on a second, opposing side of the hair clip pocket, the second hair clip pocket panel including at least one slit, and an opening located between the first hair clip pocket panel and the second hair clip pocket panel. The hair clip pocket is configured such that a hair clip is selectively insertable into the opening through the at least one slit such that a portion of the hair clip is constrained by the hair clip pocket, and a portion of the hair clip extends outside the hair clip pocket through the at least one slit.

20 Claims, 13 Drawing Sheets

HAIR AUGMENTER ATTACHMENT DEVICE INCLUDING HAIR CLIP POCKETS

CROSS-REFERENCE TO RELATED APPLICATIONS

The present application is a U.S. National State of International Patent Application No. PCT/US2013/041203, filed May 15, 2013 which claims priority to U.S. Provisional Application No. 61/647,656, filed May 16, 2012. The foregoing applications are incorporated by reference herein in their entireties.

BACKGROUND OF THE INVENTION

1. Field of the Invention

The present invention relates generally to the field of hair augmentation products, and, more particularly, to devices for attaching hair augmenters to an individuals hair, and method of performing such an attachment.

2. Description of Related Art

Hair augmenters, such as hair extensions, hair pieces, and wigs, are common in the fashion industry. Such hair augmenters are sometimes used to enhance the natural length of an individuals hair simply because it can take a long period of time for hair to grow to a desired length. Hair augmenters are also used by individuals who suffer from hair-loss, to maintain the appearance of natural hair.

Typically, hair augmenters are attached to an individual's natural hair using one of several possible methods. A first method involves attaching the hair augmenter to an individual's natural hair using a liquid adhesive or double-sided tape. A second method involves braiding the individual's natural hair, then sewing the hair augmenter onto the braids. A third method involves using hair clips to attach the hair augmenter to the individual's natural hair.

Hair clips are, perhaps, the most common method of attaching a hair augmenter to an individual's hair. However, several problems emerge from the use of such hair clips. The hair clips sometimes need to be sewn by hand into a backing seam of the hair augmenter.

This method is often burdensome, because it requires manual sewing of the hair clip into the desired location by the individual using the hair augmenter. Some hair augmenters can be purchased with hair clips already sewn into the backing seam of the hair augmenter, but such a configuration can be disadvantageous for several reasons. First, it often requires the use of metal hair clips so that the hair clips are strong enough to be securely sewn to the hair augmenter. Metal hair clips are larger, heavier, and more uncomfortable to wear than plastic clips. Furthermore, the use of metal clips can cause inconvenience or embarrassment when walking through a metal detector. Second, the hair clips must include perforations or holes for the purpose of sewing the hair clip to the hair augmenter, which adds to the size and weight of the hair clips. Third, if the hair clip breaks, it can be difficult to remove the broken hair clip from the hair augmenter and sew a new hair clip in its place.

Therefore, there is a need for an improved hair augmenter attachment device, and improved methods for attaching hair augmenters to an individual's natural hair.

SUMMARY OF THE INVENTION

According to one embodiment, an apparatus comprises a hair clip pocket comprising a first hair clip pocket panel located on a first side of the hair clip pocket, a second hair clip pocket panel located on a second, opposing side of the hair clip pocket, the second hair clip pocket panel including at least one at least one slit, and an opening located between the first hair clip pocket panel and the second hair clip pocket panel. The hair clip pocket is configured such that a hair clip is selectively insertable into the opening through the at least one slit such that a portion of the hair clip is constrained by the hair clip pocket, and a portion of the hair clip extends outside the hair clip pocket through the at least one slit.

According to another embodiment, a method comprises providing a hair clip; providing a hair augmenter; providing a hair clip pocket that is attached to the hair augmenter, the hair clip pocket comprising a first hair clip pocket panel located on a first side of the hair clip pocket, a second hair clip pocket panel located on a second, opposing side of the hair clip pocket, the second hair clip pocket panel including at least one slit, an opening located between the first hair clip pocket panel and the second hair clip pocket panel, wherein the hair clip pocket is configured such that the hair clip is selectively insertable into the opening through the at least one slit such that a portion of the hair clip is constrained by the hair clip pocket, and a portion of the hair clip extends outside the hair clip pocket through the at least one slit; and attaching the hair augmenter to an individual's hair using the hair clip.

According to another embodiment, a kit comprises a plurality of hair augmenters, each hair augmenter having a plurality of hair clip pockets attached thereto, wherein each of the hair clip pockets comprises a first hair clip pocket panel located on a first side of the hair clip pocket, a second hair clip pocket panel located on a second, opposing side of the hair clip pocket, the second hair clip pocket panel including at least one slit, an opening located between the first hair clip pocket panel and the second hair clip pocket panel, wherein each of the hair clip pockets is configured such that a hair clip is selectively insertable into the opening through the at least one slit such that a portion of the hair clip is constrained by the hair clip pocket, and a portion of the hair clip extends outside the hair clip pocket through the at least one slit.

BRIEF DESCRIPTION OF THE DRAWINGS

The accompanying drawings, which are incorporated in and constitute a part of this specification, illustrate various embodiments of the present invention, and together with the description, serve to explain the principles of the invention. In the drawings.

DETAILED DESCRIPTION OF THE PREFERRED EMBODIMENTS

Embodiments of the disclosure will be described below with reference to the accompanying drawings. It should be understood that the following description is intended to describe exemplary embodiments, and not to limit the claimed subject matter. Wherever possible, the same reference numbers will be used throughout the drawings to refer to the same or like parts.

1. Hair Clip Pockets

Figure 1A:
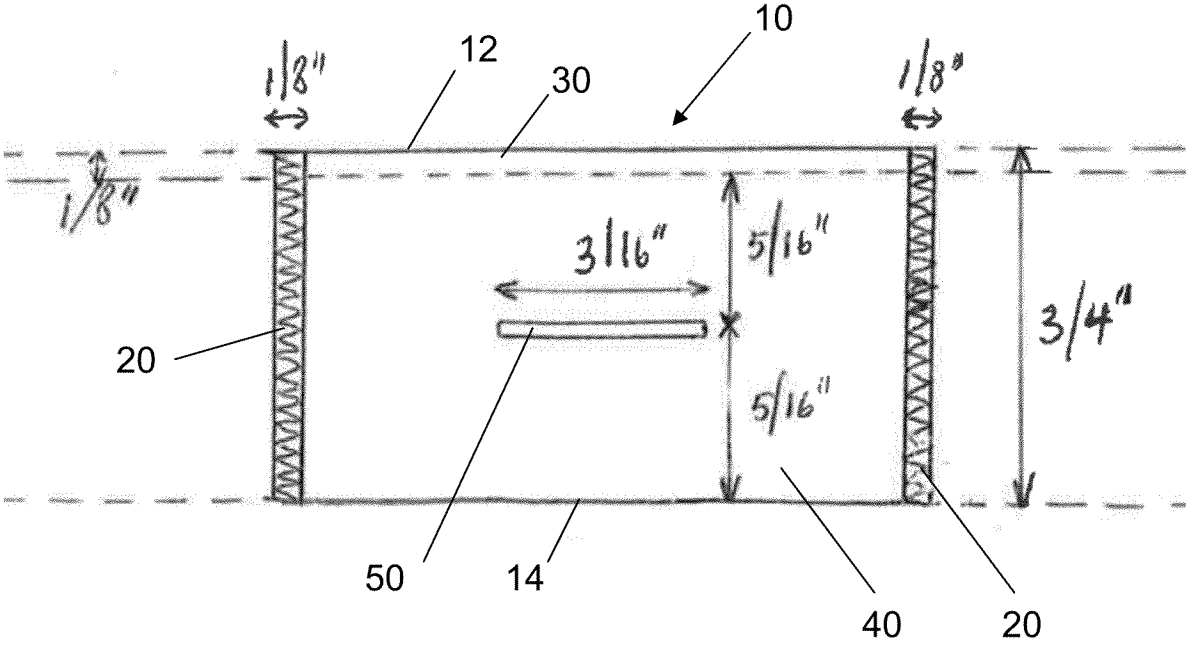
FIG. 1A is a front, schematic view of a hair clip pocket according an embodiment of the present invention.
Figure 1B:
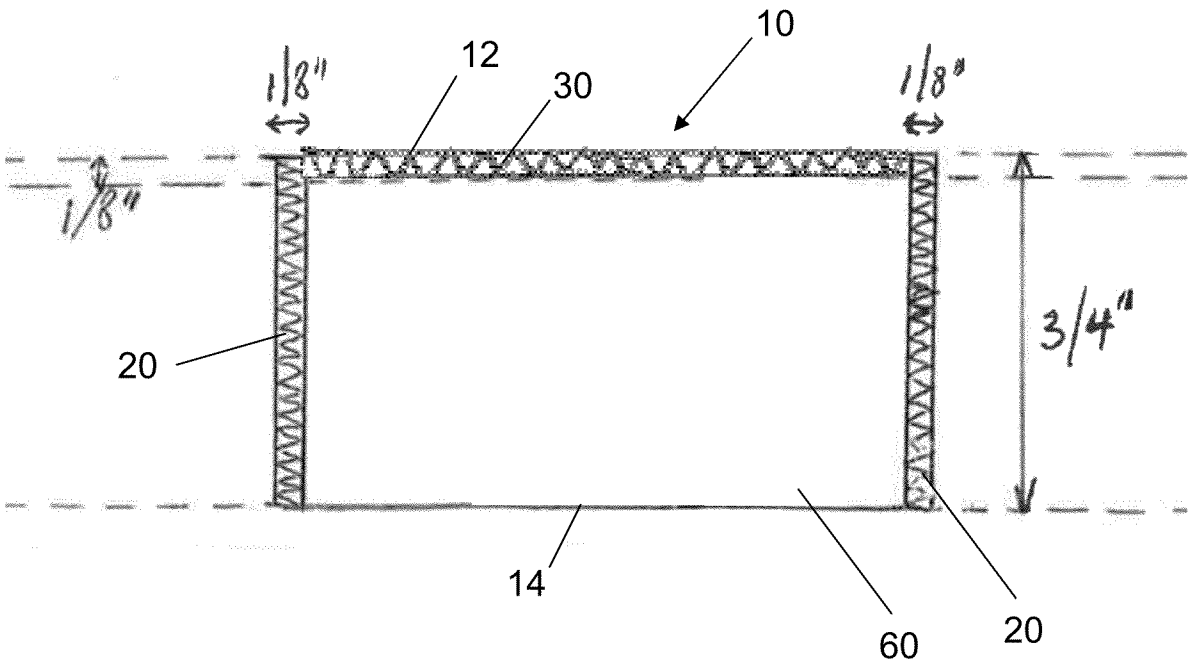
FIG. 1B is a back schematic view of the hair clip pocket depicted in FIG. 1A.

In one embodiment of the invention, depicted in FIGS. 1A and 1B, a hair clip pocket 10 is provided. FIG. 1A is a front, schematic view of a hair clip pocket according an embodiment of the present invention. FIG. 1B is a back schematic view of the hair clip pocket 10 depicted in FIG. 1A. The hair clip pocket 10 includes a front hair clip pocket panel 40, shown in FIG. 1A, and a back hair clip pocket 60, shown in FIG. 1B. The front hair clip pocket panel 40 and back hair clip pocket panel 60 form an opening 130 between the front hair clip pocket panel 40 and the back hair clip pocket panel 60, as shown, for example, in FIGS. 4B and 4C. At least one slit 50 is provided in the front hair clip pocket panel 40. The length of the slit 50 may be less than the length of the hair clip pocket 10 in the direction in which the slit 50 extends.

Figure 3:
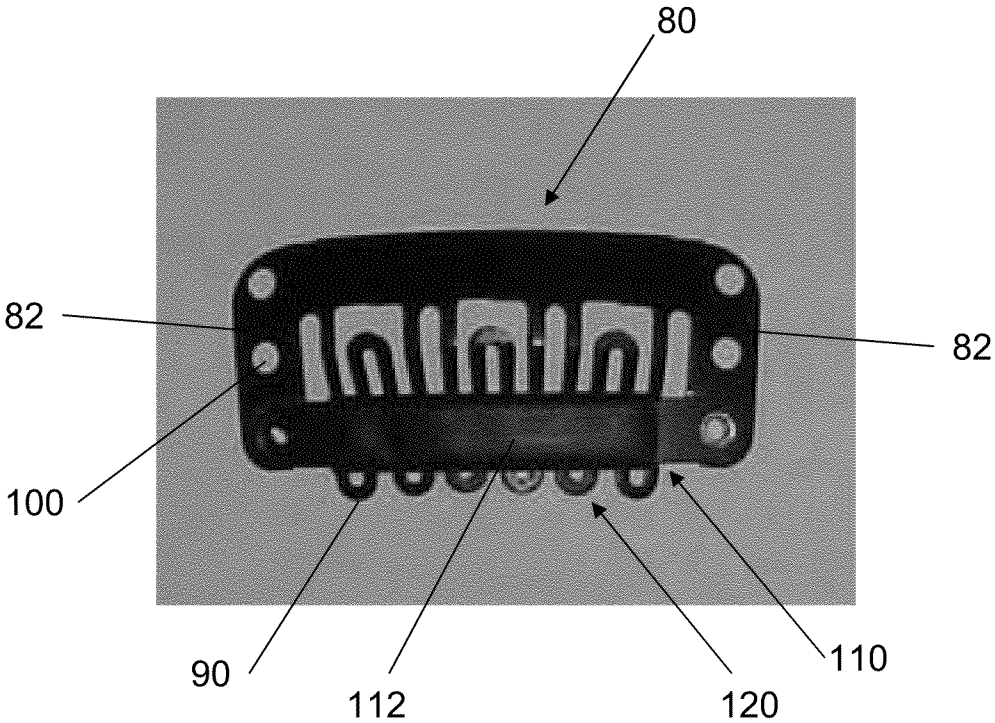
FIG. 3 illustrates an example of a hair clip that may be used in embodiments of the present invention.
Figure 4A:
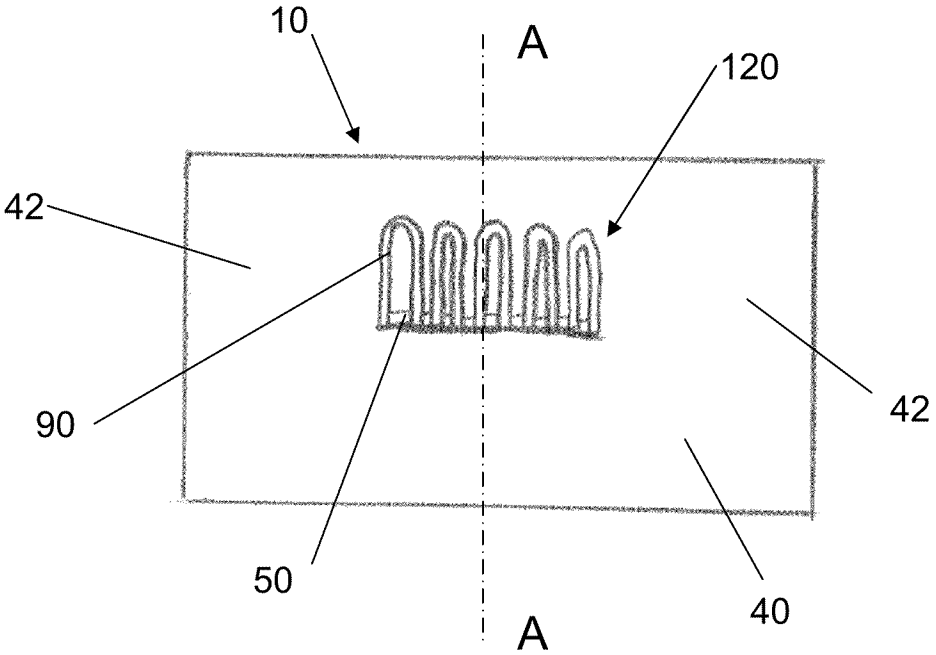
FIG. 4A is a front view of a hair clip pocket showing the prongs of a hair clip extending through a slit from an opening in the hair clip pocket.

The hair clip pocket 10 may be configured such that a hair clip, for example the hair clip 80 depicted in FIG. 3, is selectively insertable into and removable from the opening 130, through the slit 50. The hair clip pocket 10 may be configured such that, when the hair clip 80 is inserted into the opening 130, a portion of the hair clip 10 is constrained by the hair clip pocket 10, and a portion of the hair clip 10 extends outside the hair clip pocket 10 through the slit 50. For example, sides 82 of the hair clip 80 may be constrained within the opening 130 by side portions 42 of the front hair clip pocket panel 40, as shown in FIG. 4A. The side portions 42 of the front hair clip pocket panel 40 may be portions between edges of the slip 50 and edges of the hair clip pocket 10. The hair clip pocket 10 may be configured such that a clamping portion of a hair clip 80 extends outside the hair clip pocket 10 through the slit 50, as shown, for example, in FIG. 4A-4C, and discussed in more detail below.

Figure 2A:
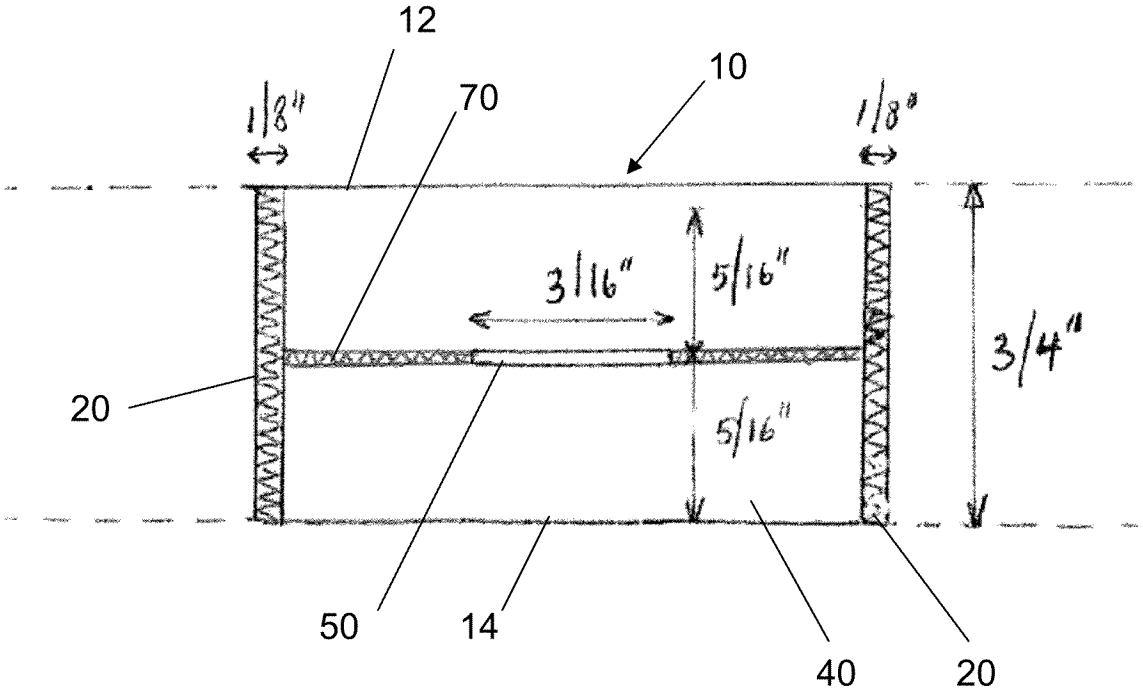
FIG. 2A is a front, schematic view of a hair clip pocket according another embodiment of the present invention.
Figure 2B:
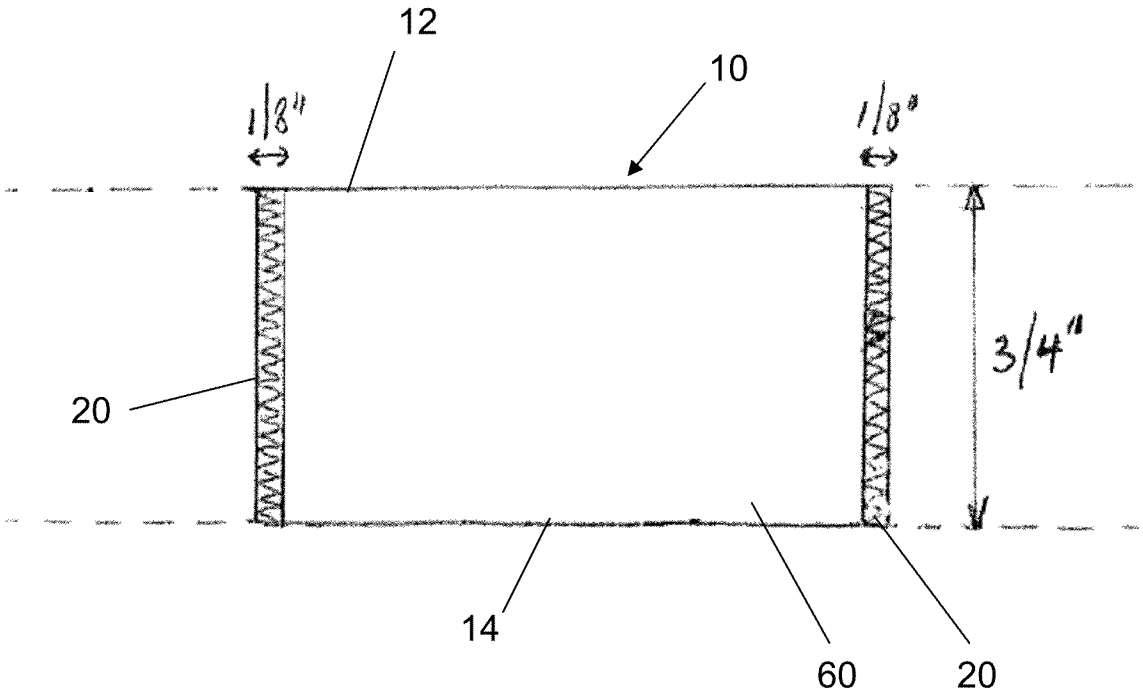
FIG. 2B is a back schematic view of the hair clip pocket depicted in FIG. 2A.

The hair clip pocket 10 may include side seams 20, and a top seam 30, which may used to attach the front hair clip pocket panel 40 to the back hair clip pocket panel 60, as shown in FIGS. 1A and 1B. Alternatively, the hair clip pocket 10 may include side seams 20 and a center seam 70, as shown in FIGS. 2A and 2B. The location of the seams is not particularly limited. Edges of the material used to form to the hair clip pocket 10 may be folded inside the hair clip pocket, such that the seams are largely invisible from outside the hair clip pocket. To accomplish this, the seams may be sewn as shown in FIGS. 1 and 2, and then the hair clip pocket may be turned inside-out to hide the seams.

The hair clip pocket 10 may be formed of a single piece of sewn material. In other words, the front hair clip pocket panel 40 and the back hair clip pocket panel 60 may be made of a single continued piece of folded material that is sewn along a seam. For example, a single piece of material may be folded along a bottom edge 14 of the hair clip pocket 10, as shown in FIGS. 1A and 1B, and ends of the single piece of material may be sewn along the top seam 30. Alternatively, the single piece of material may be folded along both the top edge 12 and the bottom edge 14 of the hair clip pocket 10, as shown in FIGS. 2A and 2B, and ends of the single piece of material may be sewn along the center seam 70. When a center seam 70 is used, the slip 50 may be formed by simply leaving a portion of the center seam 70 unsewn, as shown in FIG. 2A.

Alternatively, the front hair clip pocket panel 40 may be made of a first piece of material, and the back hair clip pocket panel 60 may be made of a second piece of material. The two pieces of material may be sewn together along their respective edges to form the opening 130 between the front hair clip pocket panel 40 and the back hair clip pocket panel 60.

Figure 7:
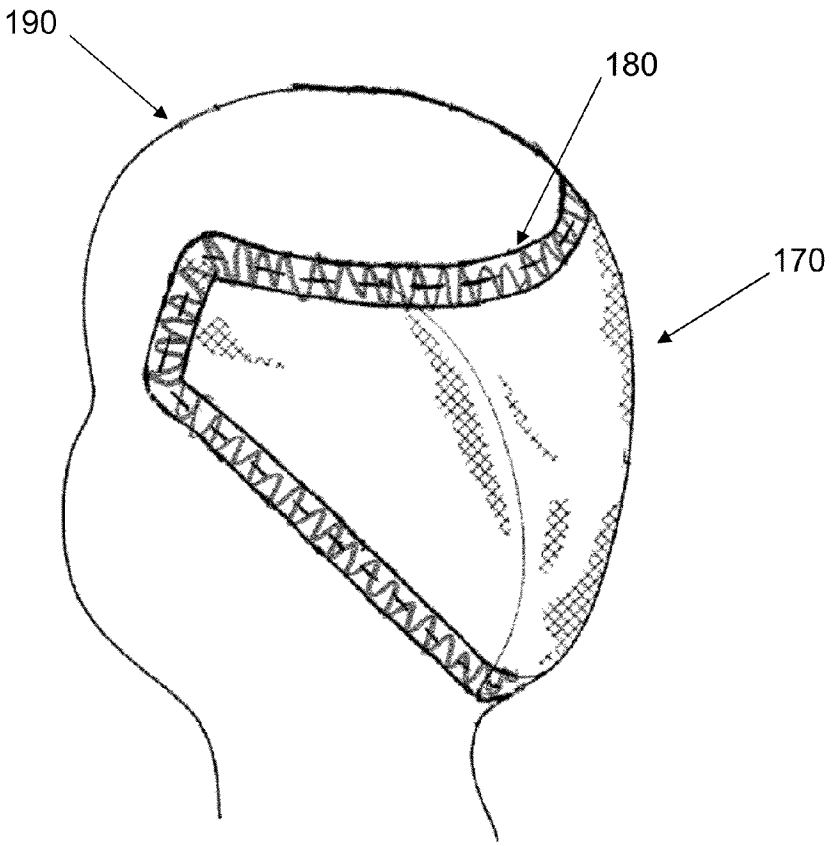
FIG. 7 illustrates a hair piece with a hair clip pocket attached thereto, where the hair piece is attached to the head of an individual.
Figure 8:
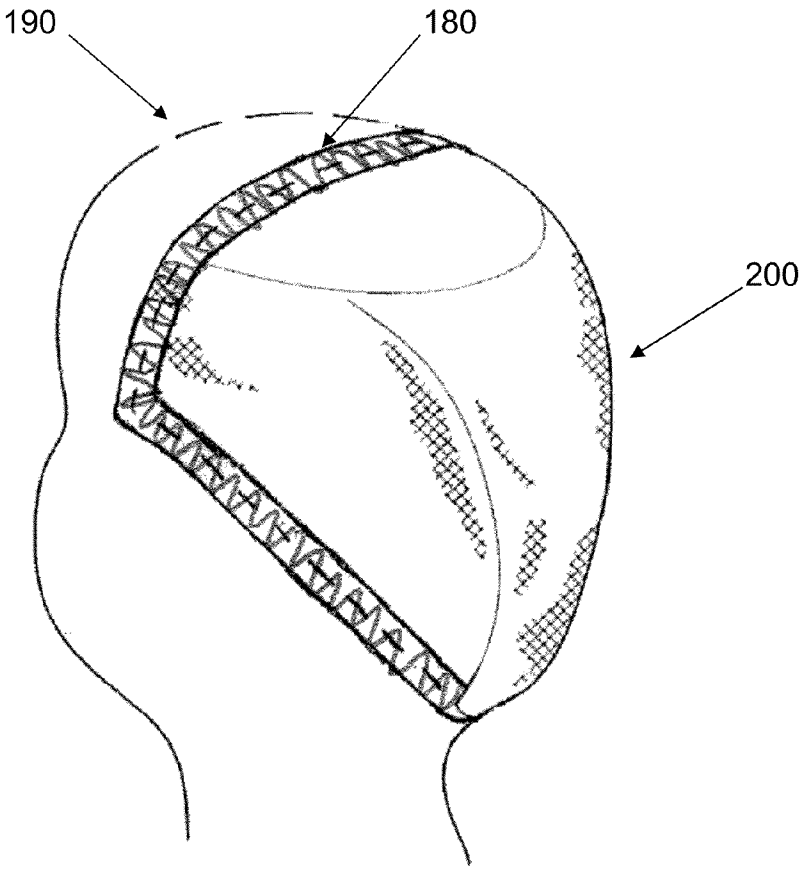
FIG. 8 illustrates a wig with a hair clip pocket attached thereto, where the wig is attached to the head of an individual.

The hair clip pocket 10 may be attached to a hair augmenter, such as a hair extension, hair piece, or wig. The hair augmenter may include a track of hair 150 attached to a backing seam 180, as shown for example, in FIGS. 7 and 8. The hair 150 of the hair augmenter may be manufactured from a synthetic material or from natural hair. The hair clip pocket 10 may be sewn or otherwise attached to the backing seam 180 of the hair augmenter. A plurality of hair clip pockets 10 may be attached to a single hair augmenter.

Figure 5A:
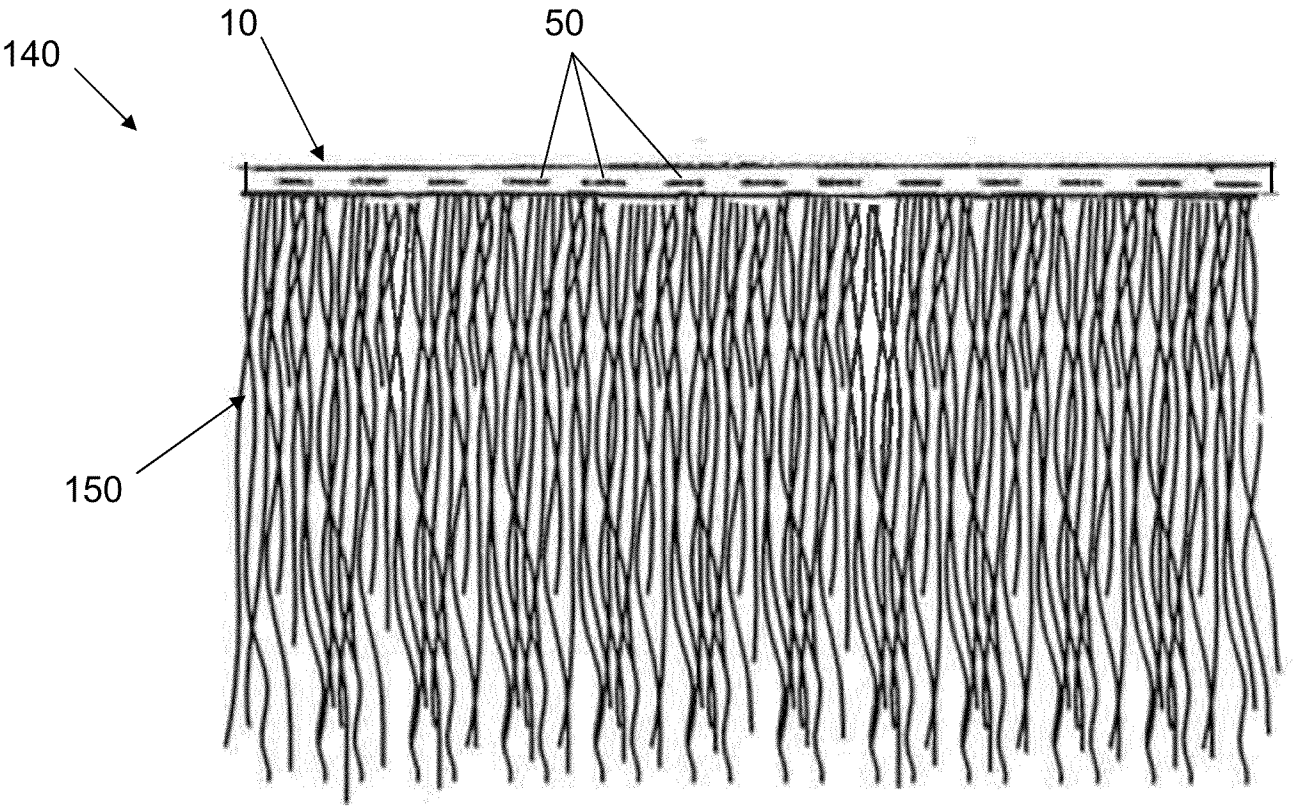
FIG. 5A is a front schematic view of a hair extension having an elongated hair clip pocket attached thereto.
Figure 5B:
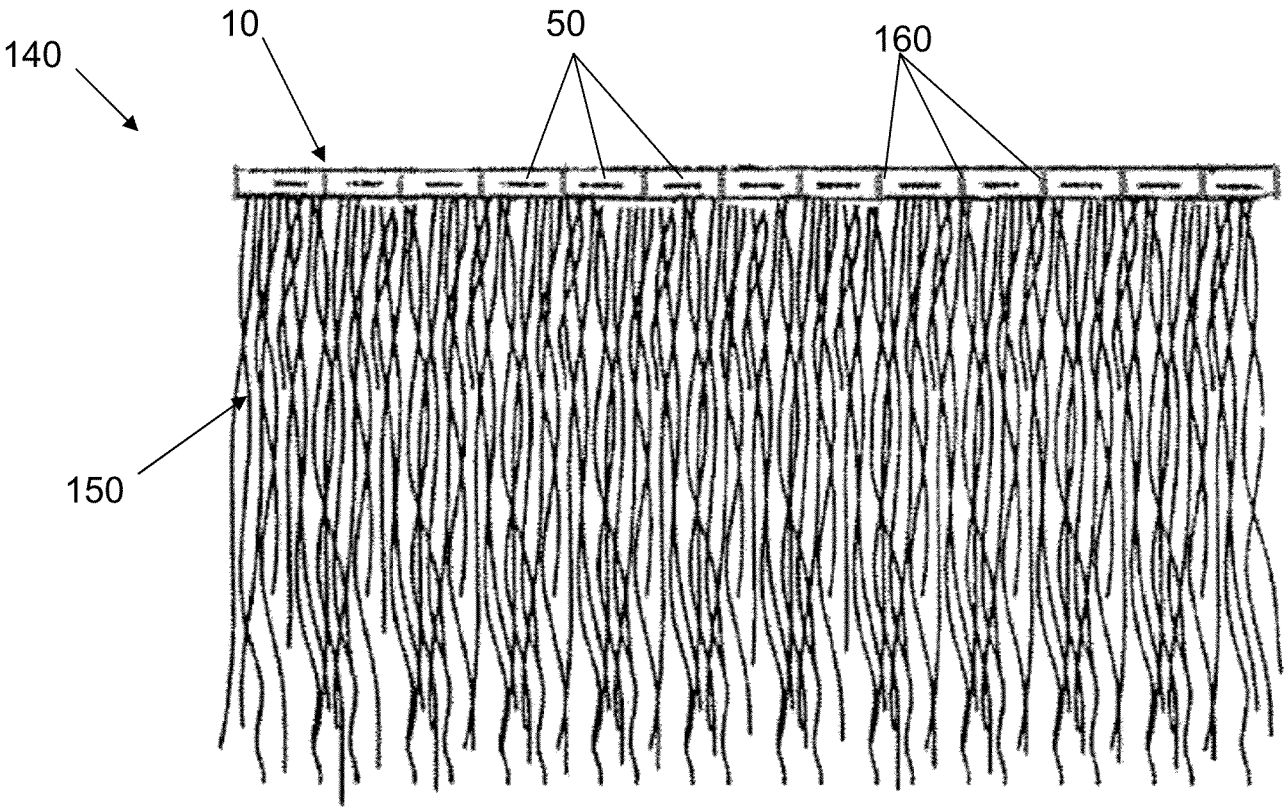
FIG. 5B is a front plan view of a hair extension having an elongated hair clip pocket attached thereto, where the slits of the elongated hair clip pocket are separated by seams.
Figure 6A:
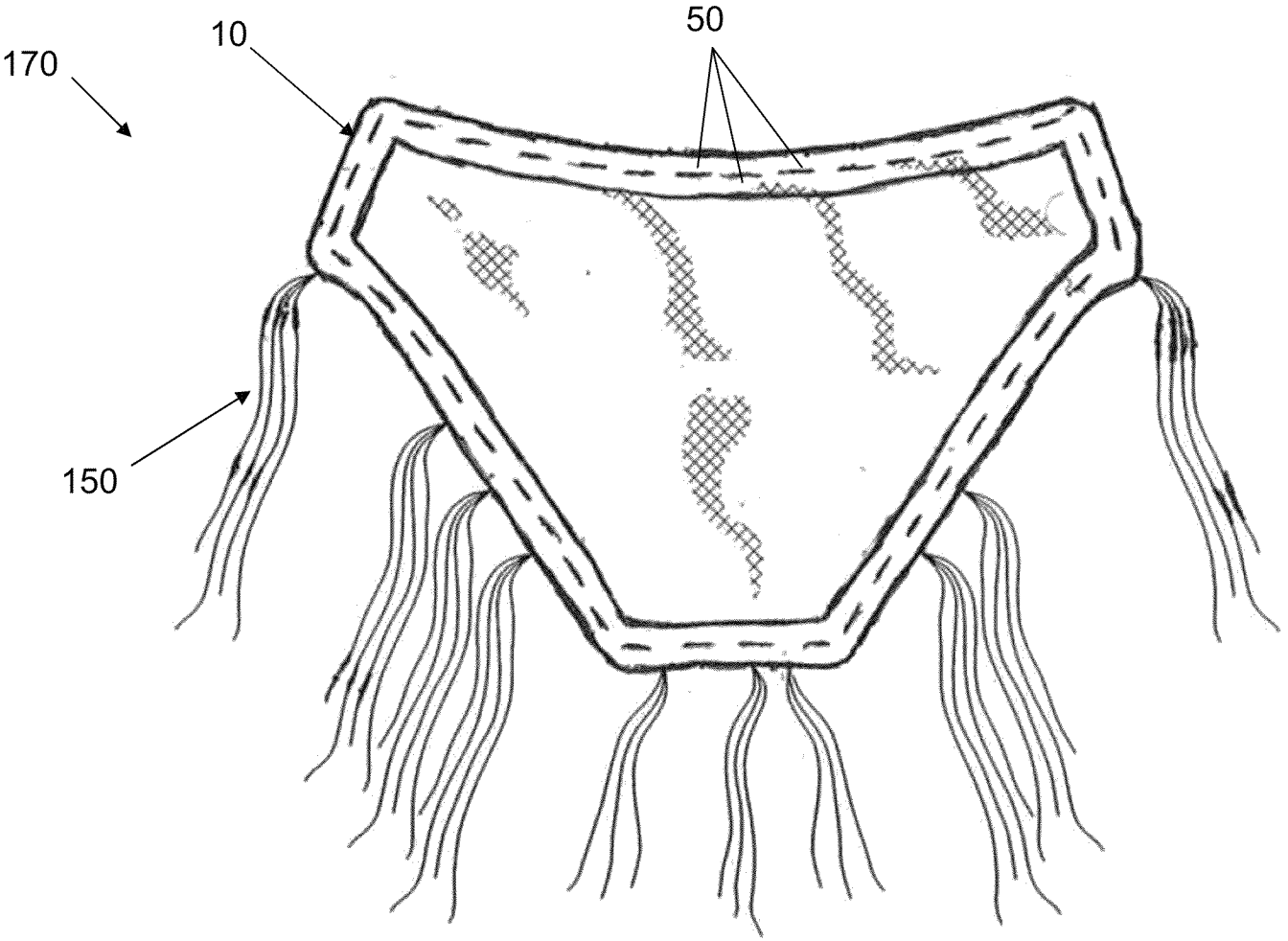
FIG. 6A is a front plan view of a hair piece having an elongated hair clip pocket attached thereto.
Figure 6B:
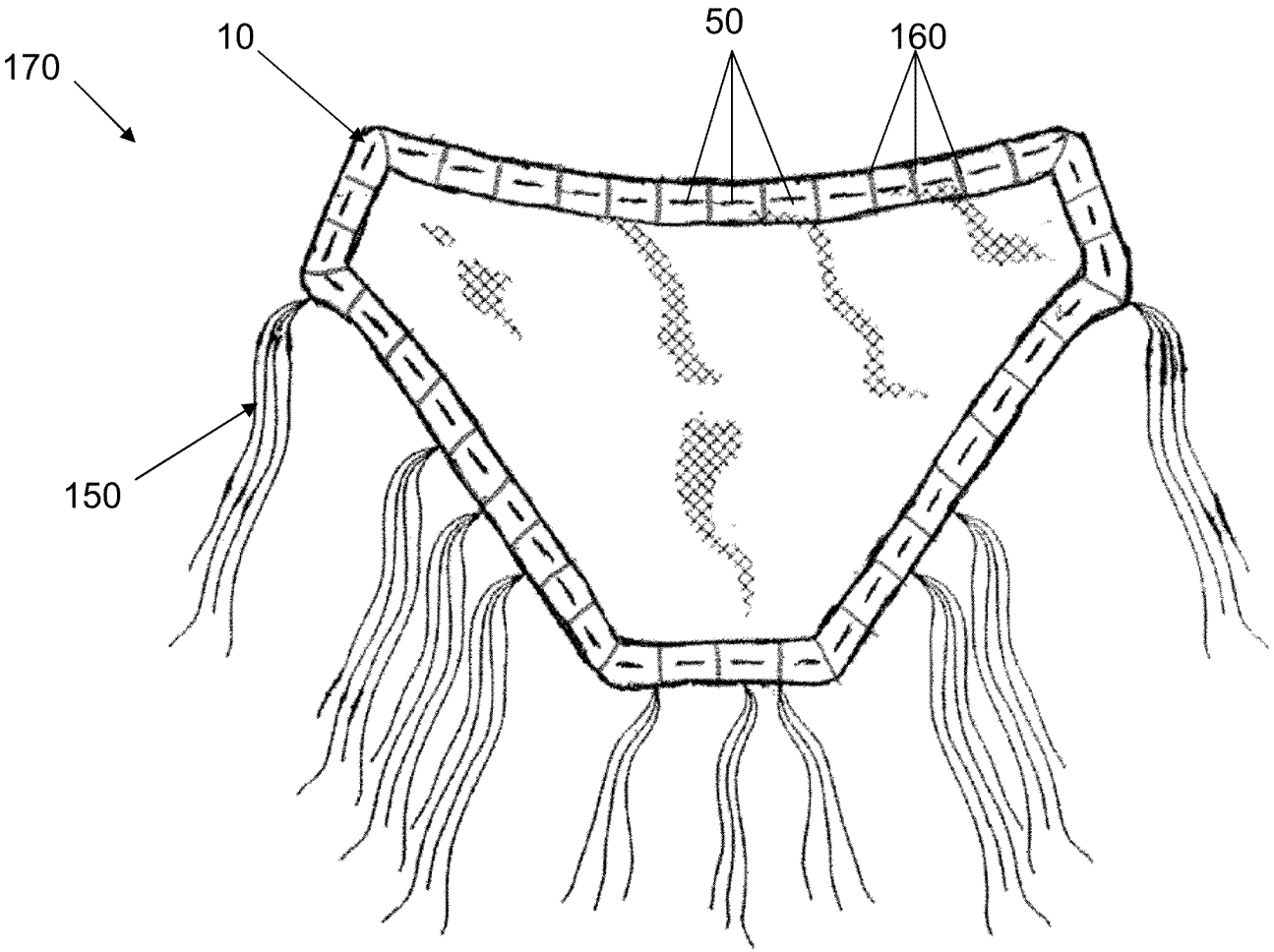
FIG. 6B is a front plan view of a hair piece having an elongated hair clip pocket attached thereto, where the slits of the elongated hair clip pocket are separated by seams.

In one embodiment, the hair clip pocket 10 may be elongated, as shown in FIGS. 5 and 6. The elongated hair clip pocket 10 may be attached to the backing seam 180 of a hair augmenter, such as a hair extension 140, as shown in FIGS. 5A and 5B, or a hair piece 170, as shown in FIGS. 6A and 6B. In this embodiment, the hair clip pocket 10 may include a plurality of slits 50 arranged in series along the second hair clip pocket panel 60 of the hair clip pocket 10, as shown in FIGS. 5A and 6A. The entire elongated hair clip pocket 10 may be formed of a single piece of material or two separate pieces of material, as discussed above.

Separating seams 160 may be included between two or more of the slits 50, as shown in FIGS. 5B and 6B, so as to create a plurality of openings in the hair clip pocket. The separating seams 160 may run in a direction perpendicular to the direction in which the slits are arranged, so as to keep the hair clips securely in position in the openings. The method of attaching the hair clip pocket 10 to the hair augmenter is not particularly limited. The hair clip pocket 10 may, for example, be attached to the backing seam 180 of the hair augmenter along the top edge 12 of the hair clip pocket. The hair clip pocket may be sewn, glued, or otherwise attached to the hair augmenter.

The hair clip pocket 10 may be made of a thin, stretchable cloth, such as nylon cloth.

Use of the hair clip pockets according to the present invention provides several noteworthy advantages. For example, use of the hair clip pockets prevents the need to sew hair clips directly to a hair augmenter. In addition, use of the hair clip pockets allows plastic hair clips to be used, which are lighter and more comfortable than metal hair clips. When the hair clip pockets are used, the hair clips need not include perforations or holes on their side portions, because the hair clip need not be sewn to another piece of material. This allows further reduction in the weight of the hair clips. Use of the hair clip pockets also allows the hair augmenter to be easily washed and replaced, and allows hair clips to be easily replaced when broken.

2. Hair Clips Usable with the Hair Clip Pockets

The type of hair clip used with the hair clip pocket 10 is not particularly limited. The hair clip may be, for example, a typical hair extension clip. The hair clip may be a T-clip, or a U-clip, such as the U-clip depicted in FIG. 3. The hair clip 80 may comprise a first clamping portion 110, and a second clamping portion 120. The first clamping portion 110 may be a single cross member, as shown in FIG. 3. The first clamping portion 110 may include a layer of padding 112, such as a thin plastic or elastomeric layer, over the cross member. The second clamping portion 120 may include a plurality of prongs 90. For example, the second clamping portion 120 may include six prongs 90, as shown in FIG. 3. The hair clip 80 may be selectively configurable between an open position, in which an individual's hair is insertable between clamping portions 110 and 120 of the hair clip 80, and a closed position, in which the individual's hair is clamped by the clamping portions 110 and 120 of the hair clip 80.

Figure 4C:
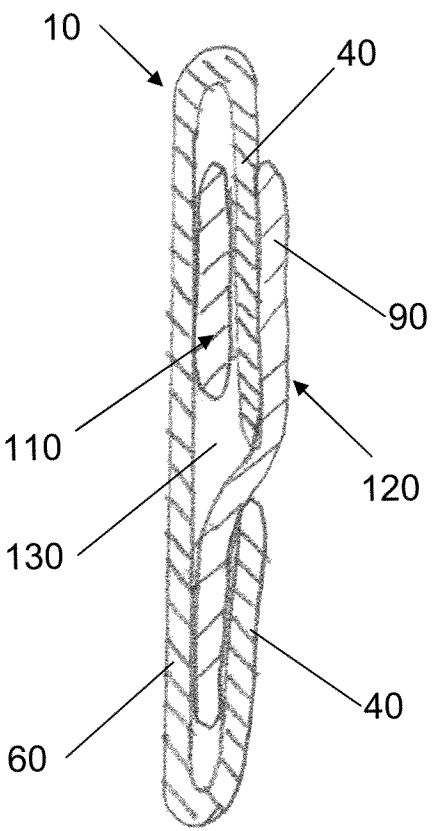
FIG. 4C is a cross-sectional view of the hair clip pocket and hair clip shown in FIG. 4A, taken along the line A-A, with the hair clip in a closed position.
Figure 4B:
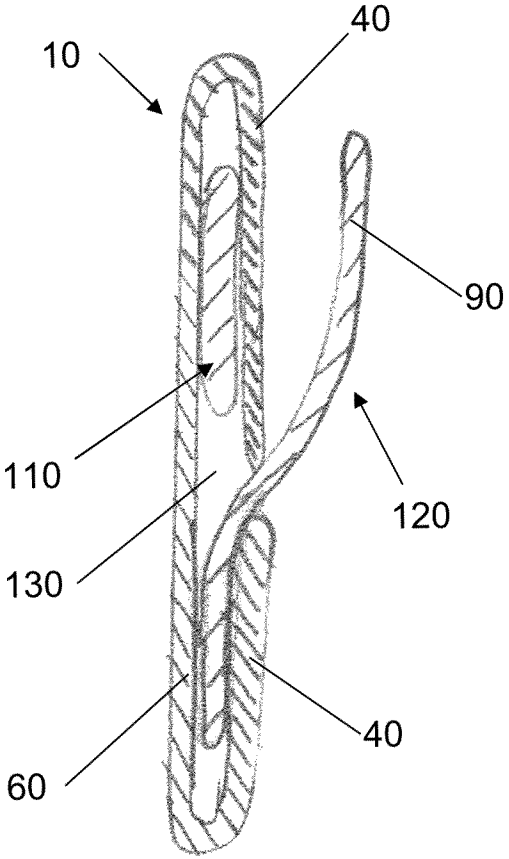
FIG. 4B is a cross-sectional view of the hair clip pocket and hair clip shown in FIG. 4A, taken along the line A-A, with the hair clip in an open position.

The hair clip 80 may be configured such that the clamping portion 120 of the hair clip 80 extends outside the hair clip pocket 10 through the slit 50, as shown in FIG. 4A-4C. The hair clip 80 may be insertable in the opening 130 such that a portion of the front hair clip pocket panel 40 is disposed between the clamping portion 110 and the clamping portion 120. Thus, when the hair clip 80 is in an open position, as shown in FIG. 4B, an individual's hair may be inserted between the front hair clip pocket panel 40 and the prongs 90 of the clamping portion 110. When the hair clip 80 is in a closed position, as shown in FIG. 4C, an individual's hair may be clamped along with a portion of the front hair clip pocket panel 40 by the clamping portions 110 and 120. The hair clip 80 is preferably made of plastic, so as to reduce the weight of the hairclip relative to typical metal hairclips. The hair clip 80 preferably does not include perforations or holes typically used to sew the hair clip 80 to a hair augmenter, so as to reduce the size and weight of the hair clip.

3. Methods of Attaching Hair Augmenters with Hair Clip Pockets

In one embodiment, a method of attaching a hair augmenter to an individual's natural hair is provided. The method includes providing a hair clip, such as the hair clip 80, providing a hair augmenter, such as a hair extension, hair piece, or wig, and providing a hair clip pocket 10. The hair clip pocket 10 may be preattached to the hair augmenter, or may be provided separately and sewn, glued, or otherwise attached to the hair augmenter. The hair clip 80 may be inserted into the opening 130 of the hair clip pocket 10, such that a portion of the hair clip is constrained by the hair clip pocket 10, and a portion of the hair clip 80 extends outside the hair clip pocket through the slit 50 of the hair clip pocket 10. The clip may then be placed in the open position, and the hair augmenter may be positioned on an individual's head in a desired location. The hair clip 80 may then be placed in the closed position such that a portion of the individual's hair is clamped by the hair clip 80. The process may be repeated for any additional hair clip pockets 10 or slits 50, so as to securely attach the hair augmenter to the individual's natural hair.

4. Kits Including Multiple Hair Augmenters with Hair Clip Pockets

In another embodiment of the invention, a kit including multiple hair augmenters is provided. Each hair augmenter may have a hair clip pocket 10 attached thereto. The hair clip pocket 10 may be configured as discussed above. The kit may include multiple hair augmenters of varying widths or sizes.

Each of the individual types of hair augmenters in the kit may be color coded. For example, the five large hair augmenters may be coded "black," the one medium hair augmenter having three hair clips may be coded "yellow," the one medium hair augmenter having two hair clips may be coded "orange," and the four small hair augmenters may be coded "blue." Of course, colors may be substituted for one another, and other colors may be used, as desired.

In one embodiment, termed the "full volume" embodiment, the kit may include five "black" hair augmenters, one "yellow" hair augmenter, one "orange" hair augmenter, and four "blue" hair augmenters. In another embodiment, termed the "light volume" embodiment, the kit may include two "black" hair augmenters, one "orange" hair augmenter, and two "blue" hair augmenters. To use the kits, the individual hair augmenters may be attached to the natural hair of an individual by following the natural curve of the head.

For example, when using the "full volume" embodiment, the "orange" hair augmenter may be first attached around the nape area. Next, a "black" hair augmenter may be attached starting from the right ear area. Next, another "black" hair augmenter may be attached above the left ear. Next, three additional "black" hair augmenter may be attached alternating right and left and working up to the crown of the head. Then, a "yellow" hair augmenter may be attached to the middle top (i.e., "crown") of the head. Next, a "blue" hair augmenter may be attached to the right side, at the crown of the head. Finally, another "blue" hair augmenter may be attached to the right side, at the crown of the head, near the midline. A half inch of hair may be left to cover the last piece for a natural look, or a closure, such as a very small hair piece, may be used to cover the last piece.

When using the "light volume" embodiment, the "orange" hair augmenter may be first attached around the nape area. Next, a "black" hair augmenter may be attached above the right ear. Then, another "black" hair augmenter may be attached above the left ear. Finally, two "blue" hair augmenters may be attached below the crown area, one on each side of the hear. The individual's hair may be used to cover the last pieces for a natural look.

To remove the hair augmenters, the individual's hair may be first combed from ends to scalp. Next, the hair augmenters may be removed starting from the nape area and proceeding to the top of the head. Hair clips may be closed after removal, for washing.

In this document, colors and relational terms, such as "first," "second," "top," "bottom," "front," and "back," are used only to distinguish one element from another element, without necessarily requiring or implying any physical or logical relationship or order between such elements.

While the preferred embodiments of the devices and methods have been described in reference to the environment in which they were developed, they are merely illustrative of the principles of the inventions. Modification or combinations of the above-described assemblies, other embodiments, configurations, and methods for carrying out the invention, and variations of aspects of the invention that are obvious to those of skill in the art are intended to be within the scope of the claims.

What is claimed is:

1. An apparatus comprising:

a hair clip pocket comprising:

a first hair clip pocket panel located on a first side of the hair clip pocket, a second hair clip pocket panel located on a second, opposing side of the hair clip pocket, the second hair clip pocket panel including at least one slit, and an opening located between the first hair clip pocket panel and the second clip pocket panel, wherein the hair clip pocket is configured such that a hair clip is selectively insertable into the opening through the at least one slit such that a portion of the hair clip is constrained by the hair clip pocket, and a portion of the hair clip extends outside the hair clip pocket through the at least one slit.

2. The apparatus of claim 1, wherein the hair clip pocket is elongated and comprises a plurality of slits arranged in series along the second hair clip pocket panel of the elongated hair clip pocket.

3. The apparatus of claim 2, further comprising:

a hair augmenter comprising a backing seam, wherein the hair clip pocket is attached to the backing seam of the hair augmenter.

4. The apparatus of claim 3, wherein the hair augmenter is a hair extension, a hair piece, or a wig.

5. The apparatus of claim 2, wherein the plurality of slits are separated from one another by seams.

6. The apparatus of claim 1, further comprising:

a hair augmenter comprising a backing seam, wherein a plurality of the hair clip pockets are attached to the backing seam of the hair augmenter.

7. The apparatus of claim 6, wherein the hair augmenter is a hair extension, a hair piece, or a wig.

8. The apparatus of claim 1, wherein a length of the at least one slit is less than a length of the hair clip pocket, such that a portion of the hair clip is constrained by a portion of the hair clip pocket between an edge of the at least one slit and an edge of the hair clip pocket.

9. The apparatus of claim 1, wherein the hair clip pocket is formed of a single piece of sewn, stretchable cloth material.

10. The apparatus of claim 1, wherein the hair clip pocket comprises a single piece of sewn nylon cloth.

11. The apparatus of claim 1, wherein:

the hair clip is selectively configurable between an open position, in which an individual's hair is insertable between clamping portions of the hair clip, and a closed position, in which the individual's hair is clampable by the clamping portions of the hair clip, and the hair clip is insertable in the opening such that a portion of the second hair clip pocket panel is disposed between the clamping portions of the hair clip.

12. The apparatus of claim 11, wherein at least one of the clamping portions of the hair clip comprises a plurality of prongs.

13. The apparatus of claim 1, wherein the hair clip is made of plastic.

14. The apparatus of claim 1, wherein the hair clip does not include holes on lateral sides of the hair clip.

15. The apparatus of claim 1, wherein the second hair clip pocket panel is configured to be disposed between a portion of the hair clip and an individual's hair.

16. A method comprising:

providing a hair clip;

providing a hair augmenter;

providing a hair clip pocket that is attached to the hair augmenter, the clip pocket comprising:

a first hair clip pocket panel located on a first side of the hair clip pocket, a second hair clip pocket panel located on a second, opposing side of the hair clip pocket, the second hair clip pocket panel including at least one slit, an opening located between the first hair clip pocket panel and the second hair clip pocket panel, wherein the hair clip pocket is configured such that the hair clip is selectively insertable into the opening through the at least one slit such that a portion of the hair clip is constrained by the hair clip pocket, and a portion of the hair clip extends outside the hair clip pocket through the at least one slit; and attaching the hair augmenter to an individual's hair using the hair clip.

17. The method of claim 16, further comprising inserting the hair clip into the hair clip pocket.

18. A kit comprising:

a plurality of hair augmenters, each hair augmenter having at least one hair clip pocket attached thereto, wherein the at least one hair clip pocket comprises:

a first hair clip pocket panel located on a first side of the hair clip pocket, a second hair clip pocket panel located on a second, opposing side of the hair clip pocket, the second hair clip pocket panel including at least one slit, an opening located between the first hair clip pocket panel and the second hair clip pocket panel, wherein the at least one hair clip pocket is configured such that a hair clip is selectively insertable into the opening through the at least one slit such that a portion of the hair clip is constrained by the hair clip pocket, and a portion of the hair clip extends outside the hair clip pocket through the at least one slit.

19. The kit of claim 18, wherein at least one of the hair clip pockets is elongated and comprises a plurality of slits arranged in series along the second hair clip pocket panel of the elongated hair clip pocket.

20. The kit of claim 18, wherein the plurality of hair augmenters includes a first hair augmenter having a first width, and a second hair augmenters having a second width that is different from the first width.

* * * * *